US006769834B1

(12) United States Patent
Stange

(10) Patent No.: US 6,769,834 B1
(45) Date of Patent: Aug. 3, 2004

(54) METHODS AND APPARATUS FOR COVERING OPENINGS IN ROADWAYS

(76) Inventor: Henry E. Stange, P.O. Box 883, Owatonna, MN (US) 55060-0833

( * ) Notice: Subject to any disclaimer, the term of this patent is extended or adjusted under 35 U.S.C. 154(b) by 649 days.

(21) Appl. No.: 09/314,079

(22) Filed: May 19, 1999

(51) Int. Cl.[7] ..... E02D 29/14
(52) U.S. Cl. ..... 404/25; 404/26; 52/20
(58) Field of Search ..... 404/25, 26; 411/330, 411/155; 52/20

(56) References Cited

U.S. PATENT DOCUMENTS 1,060,064 A * 4/1913 Burgess ..... 411/155
2,735,470 A * 2/1956 Poupitch ..... 411/155
4,597,692 A * 7/1986 Gruenwald ..... 404/25
4,614,065 A * 9/1986 Papp ..... 404/26
4,740,123 A * 4/1988 Wollar et al. ..... 411/38
4,934,715 A * 6/1990 Johnson ..... 404/25
4,973,191 A * 11/1990 Dannhauser ..... 404/25
5,056,975 A * 10/1991 Ando ..... 411/155
6,036,401 A * 3/2000 Morina et al. ..... 404/26

* cited by examiner

*Primary Examiner*—Thomas B. Will
*Assistant Examiner*—Raymond W Addie
(74) *Attorney, Agent, or Firm*—IPLM Group, P.A.

(57) ABSTRACT

A mat is disposed on top of an access cover to compensate for a vertical offset between the top of the cover and the top of the roadway surrounding the cover. Fasteners are inserted through aligned holes in the mat and the cover and anchored in place in such a manner that the heads of the fasteners do not protrude above the top of the cover.

29 Claims, 5 Drawing Sheets

METHODS AND APPARATUS FOR COVERING OPENINGS IN ROADWAYS

FIELD OF THE INVENTION

The present invention relates to covers disposed over openings extending downward through roadways, and in particular, to mats which occupy cavities bounded by the tops of the covers and the roadway disposed about the covers.

BACKGROUND OF THE INVENTION

Openings are formed in roadways to provide access to things disposed beneath the roadways, including, for example, water and sewage lines. One commonly known opening is a manhole, which is typically defined by a frame set in the roadway, and sealed by a manhole cover resting on top of the frame. One problem associated with manhole covers is that they do not always remain flush with the surrounding road surface. For example, roadways often buckle or heave in response to temperature changes associated with the different seasons of the year. Also, when roadways are resurfaced, additional material is added to the road surface disposed about the manhole frame. In either of these cases, the road surface increases in elevation relative to the top of the manhole cover, leaving a cavity or depression in the surface of the road.

One proposed solution to the foregoing problem is to fill the depression with asphalt. However, this approach suffers shortcomings, including the inconvenience of applying the asphalt; the inconvenience of removing the covering when access to the opening is desired; the durability of the small, isolated patch of asphalt; and/or the inconvenience of removing the asphalt in the event that the road surface returns to an earlier, relatively lower level.

Another proposed solution to the foregoing problem is to add a ring on top of the manhole frame (beneath the cover) to raise the height of the manhole cover. However, this approach suffers shortcomings, as well, including the inconvenience of installing the ring; the unsuitability of the rings for adjustments less than one and one-half inches and/or for adjustments in increments as little as one-quarter of an inch; and the inconvenience of removing the ring in the event that the road surface returns to an earlier, relatively lower level.

In other words, a need remains for a convenient and effective system which compensates for elevational changes between a manhole cover and the surrounding road surface.

SUMMARY OF THE INVENTION

One aspect of the present invention is to mount a mat or surface elevation riser on top of an access cover for purposes of eliminating an elevational discrepancy between the surface of the cover and the surface of the surrounding roadway. This inventive solution to the problem discussed above in the Background of the Invention is not as simple as it may first seem to those unfamiliar with the installation considerations and environmental conditions associated with access covers, such as manhole covers. For example, many manhole covers are regularly traversed by vehicles of various weights, traveling in various directions, and/or at various speeds. Also, many different installation parameters may vary from one setting to the next. Moreover, work on the covers typically involves the diversion of traffic, thereby placing a premium on rapid project completion.

A preferred embodiment of the present invention includes a mat which is bolted to an underlying cover. Relatively thin, flat heads are provided at one end of the bolts, and lock nuts are threaded onto opposite ends of the bolts in such a manner that the heads do not protrude above the surface of the mat. The threaded ends of the bolts, as well as the lock nuts, are disposed beneath the cover and out of harm's way.

The preferred embodiment mat is made of recycled rubber, 67 durometer, and may be as little as one-half inch thick. The mat may be configured to provide access to a lift hole or other special opening in the cover. The mat also may be configured to overlie any such openings and/or the seam between the cover and adjacent structure, thereby reducing passage of water and/or debris through the opening. Assuming a substitute cover is available, the mat may be installed and/or removed off-site, thereby reducing disruption of traffic. Additional aspects and advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
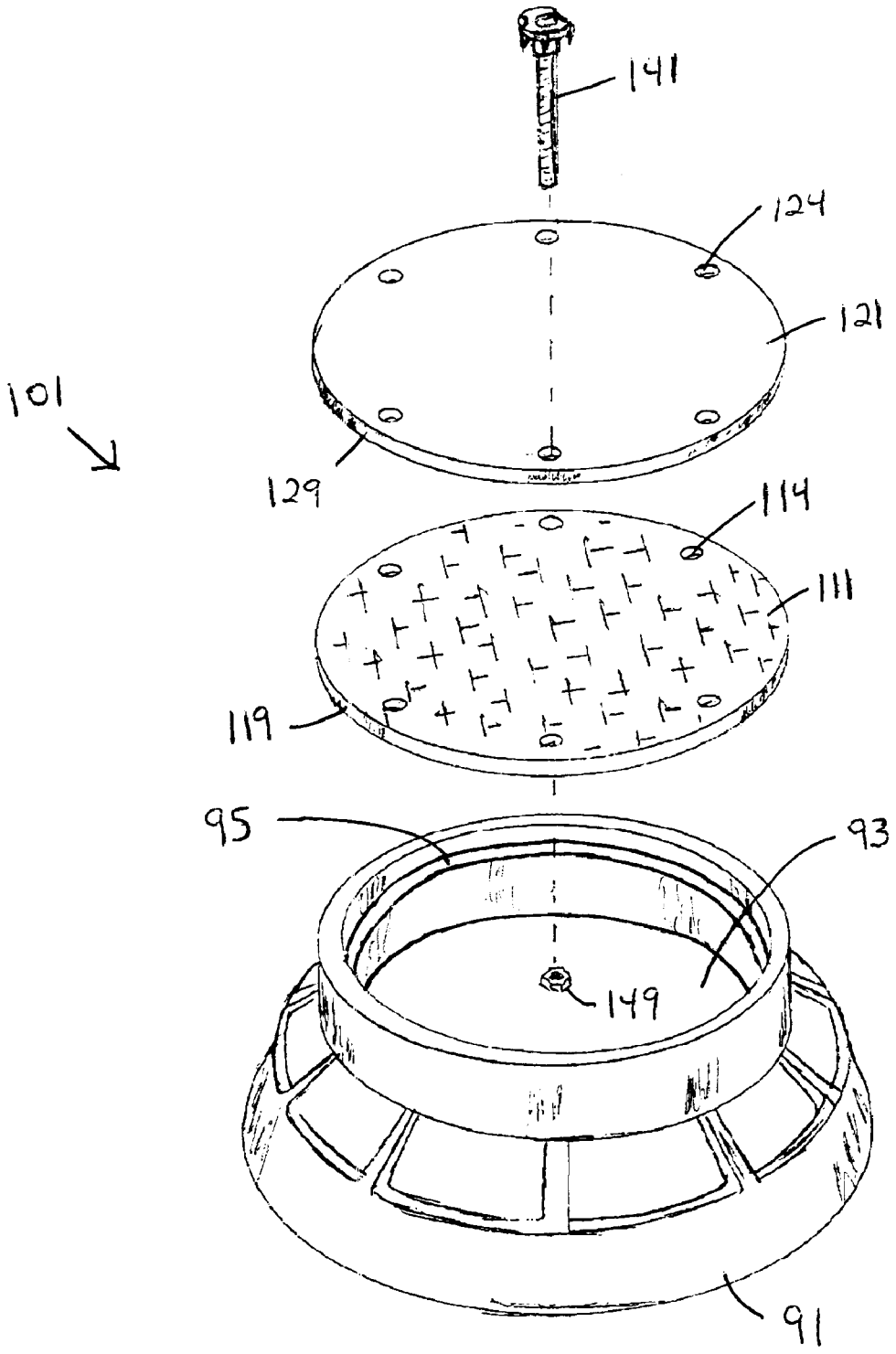
FIG. 1 is an exploded perspective view of a preferred embodiment manhole assembly constructed according to the principles of the present invention.
Figure 4:
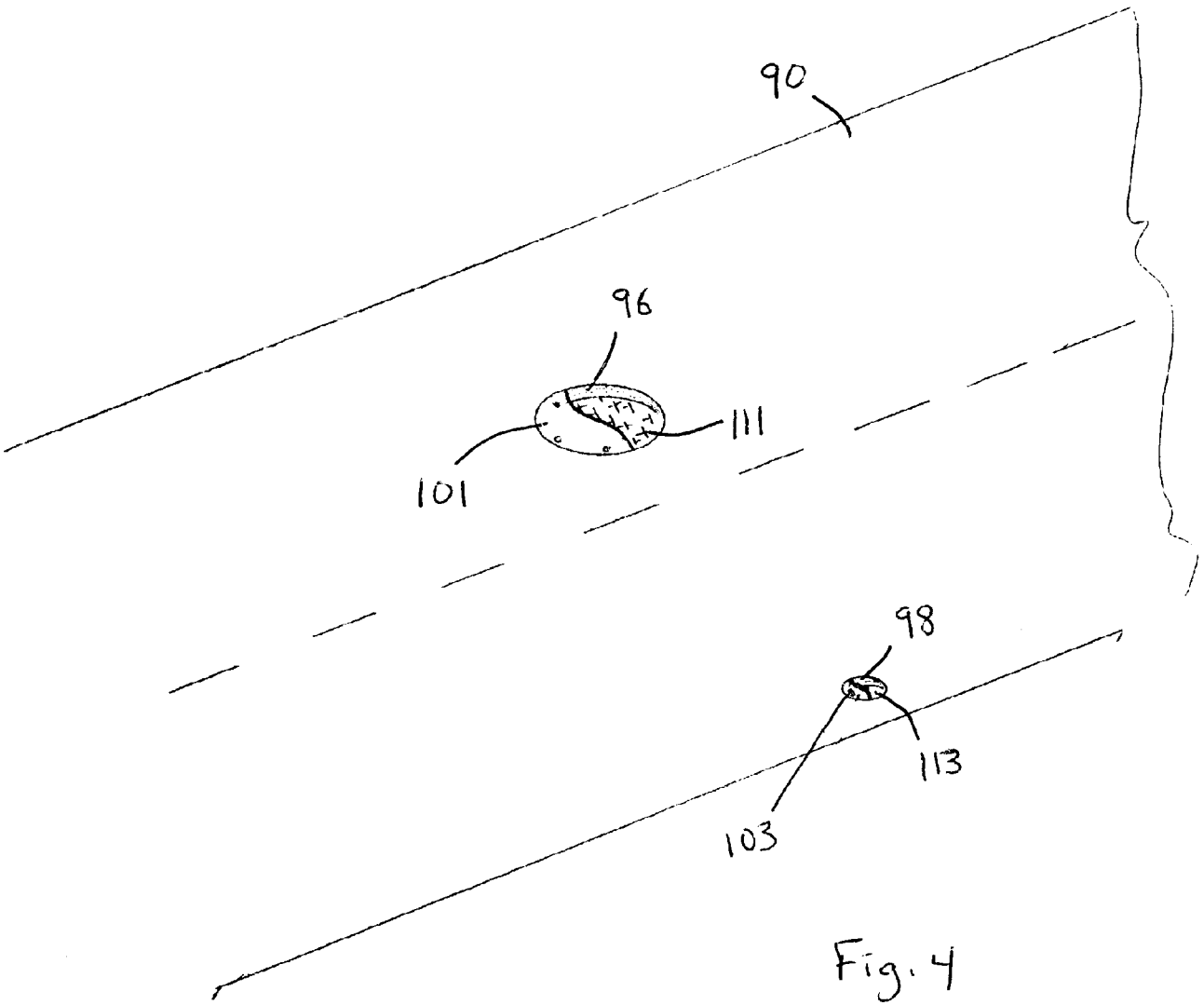
FIG. 4 is a perspective view of a roadway provided with the assembly of FIG. 1 and another, relatively smaller assembly like that of FIG. 1.

A preferred embodiment manhole cover assembly, constructed according to the principles of the present invention, is designated as 101 in FIGS. 1 and 4. The assembly 101 generally includes a manhole cover 111, a mat 121, and at least two fasteners 141. The assembly 101 is supported by a conventional manhole frame 91 which includes a circular opening 93 and a cover recess or ledge 95 projecting into the opening 93 to support the manhole cover 111.

The cover 111 is an otherwise conventional part which has been modified in accordance with the principles of the present invention. In particular, circumferentially spaced holes 114 extend through the cover 111, preferably within two inches of the outer edge 119 thereof. The arc length between any two adjacent holes 114 is preferably less than ten inches.

The mat 121 is a disc which has been cut from a sheet of rubber, preferably 67 durometer. The mat 121 has a diameter which is based upon the diameter of the cover 111 and/or the surrounding frame 91, and a thickness which is based upon the magnitude of vertical offset 96 between the top of the cover 111 and the top of the road surface 90 (as shown in FIG. 4). In this regard, the mat 121 is sized and configured to span the cover 111 and occupy the cavity bounded by the top of the cover 111 and the surrounding roadway 90. Circumferentially spaced holes 124 extend through the mat 121 at least one inch inside the outer edge 129 thereof. The holes 124 in the mat 121 are preferably formed together with the holes 114 in the cover 111, and in any event, the holes 124 are alignable with the holes 114 for purposes of receiving respective fasteners 141.

Figure 3:
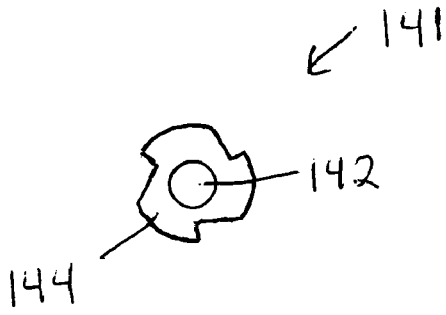
FIG. 3 is a top view of the fastener of FIG. 2.
Figure 2:
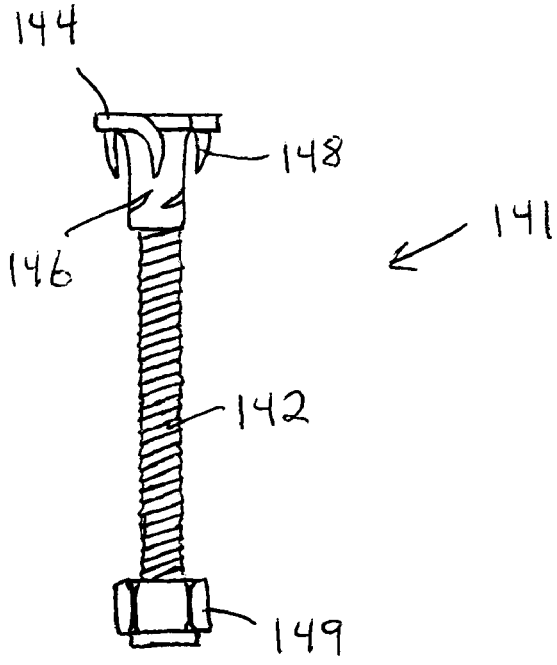
FIG. 2 is a side view of a preferred embodiment fastener present on the assembly of FIG. 1.

One of the fasteners 141 is shown in greater detail in FIGS. 2–3. Each fastener 141 includes a threaded shaft 142 sized and configured for insertion through the holes 124 and 114. A T-shaped head 144 is anchored to one end of the shaft 142 in such a manner that the fastener 141 terminates in a relatively thin, flat flange which extends perpendicular to the shaft 142. For purposes of producing relatively small quantities of the fasteners 141, the head 144 is threaded onto the shaft 142 and anchored in place by crimping (in the regions designated as 146). Three circumferentially spaced teeth (or pointed flanges) 148 are cut from the flat portion of the head 144 and bent to extend parallel to the shaft 142 and toward the opposite, distal end thereof. A nylon lock nut 149 is selectively threaded onto the opposite end of the shaft 142.

With the manhole frame 91 anchored within the roadway 90, the assembly 101 is preferably constructed in the following manner. Both the magnitude of the offset 96 and the size of the cover 111 are ascertained, and an appropriately sized mat 121 is obtained. The cover 111 (prior to the provision of holes 114) may be replaced by a temporary cover and taken to a suitable work place, together with the mat 121. The mat 121 is placed upside down on top of a work surface, and the cover 111 is placed upside down on top of the mat 121. The cover 111 is maintained in a centered position relative to the mat 121, and the holes 114 and 124 are drilled through the cover 111 and the mat 121, respectively. Each fastener 141 is inserted through a hole 124 in the mat 121 and then through an aligned hole 114 in the cover 111. The teeth 148 on the fasteners 141 are forced into the mat 124 by tamping with a hammer. The nuts 149 are threaded onto respective shafts 142 until the cover 111 and the mat 121 are clamped therebetween, and the heads 144 are slightly recessed relative to the top of the mat 121. The cover assembly 101 is then returned to the site of the frame 91 and substituted for the temporary cover.

The mat 121 is considered advantageous because it is made from recycled rubber and provides a relatively high friction surface, as compared to the cover 111 itself. Also, the mat 121 may be made as little as one-half of an inch thick without sacrificing durability, and/or in reliable thickness increments as small as one-quarter of an inch. The mat 121 also may be conveniently removed or complemented with another mat, depending on subsequent changes in the elevation of the roadway 90.

The fasteners 141 are considered advantageous because they do not protrude above the top of the mat 121, and/or they do not require countersink holes in the mat 121. Also, the shafts 142 need not be a specific length, because they are free to extend downward beneath the cover 111 and the nuts 149. Moreover, the nuts 149 remain fixed to the shafts 142 despite being subjected to all sorts of forces and vibrations.

Figure 7:
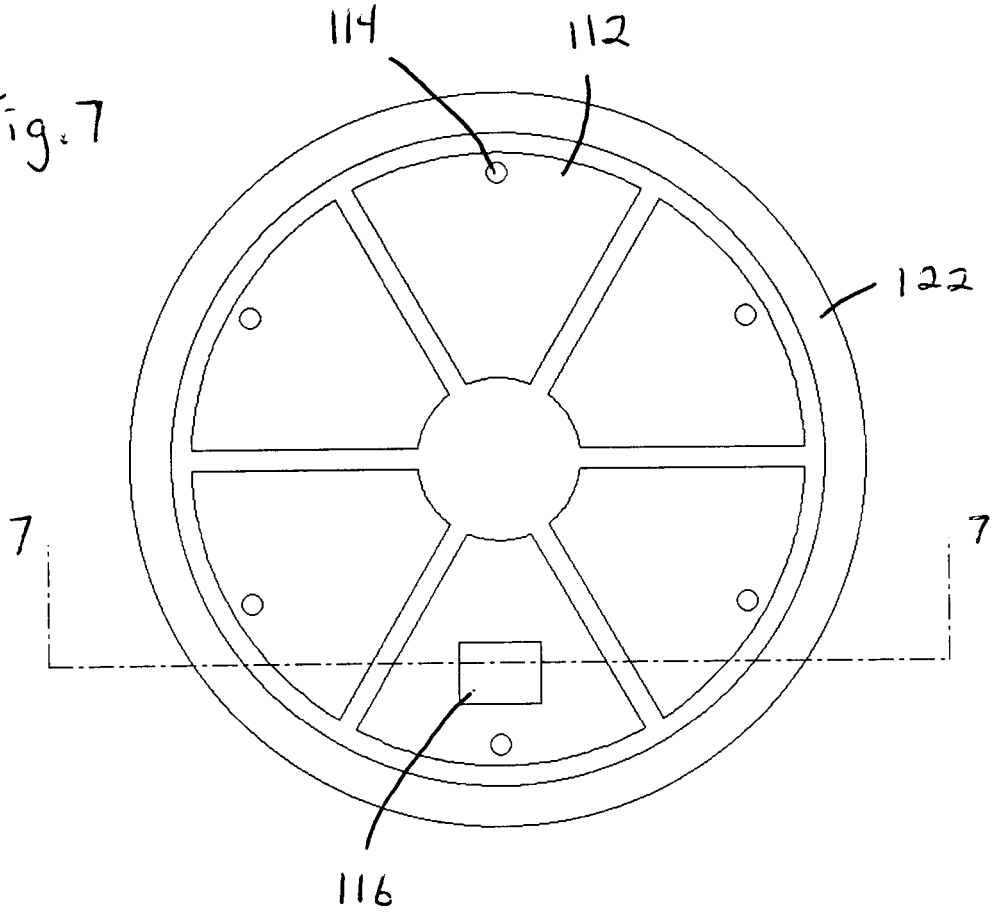
FIG. 7 is a bottom view of an alternative cover assembly constructed in accordance with the principles of the present invention.
Figure 8:
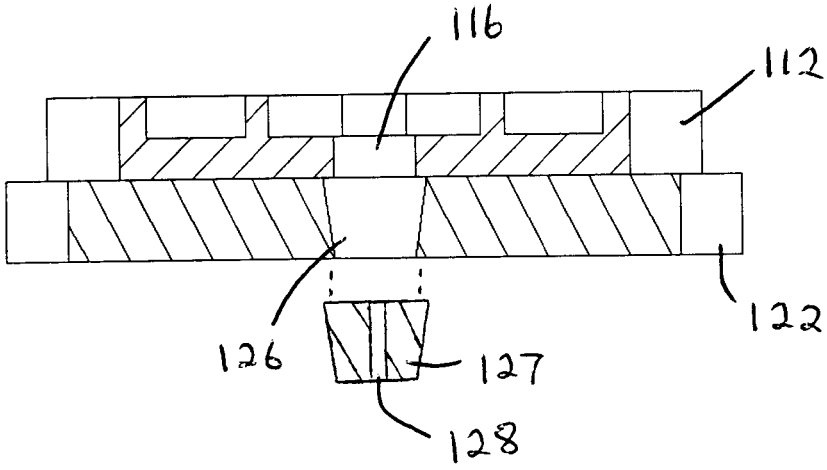
FIG. 8 is a partially sectioned side view of the assembly of FIG. 7, with the thickness of the parts exaggerated for purposes of illustration.

In order to facilitate discussion of additional, optional features of the present invention, FIGS. 7–8 show a second cover 112 and a second mat 122. A lift hole 116 extends through the cover 112 to facilitate removal thereof from the frame 91. In accordance with the present invention, holes 114 extend through the cover 112 and align with holes in the mat 122. Also, assuming sufficient tolerance in the surrounding roadway, the mat 122 is two inches larger in diameter than the cover 112 and thus, overlies both the cover 112 and the seam between the cover 112 and the frame 91. As a result, water and debris are less likely to pass between the cover 112 and the frame 91 and into the sewage line.

A hole 126 is cut in the mat 122 to provide access to the lift hole 116. The hole 126 is preferably cut with sidewalls that extend in slightly divergent fashion toward the cover 112, and the resulting block or plug 127 is preferably returned to the hole 126 until access to the lift hole 116 is desired. The slightly divergent sidewalls of the hole 126 encourage the plug 127 to remain inside the hole 126. A relatively smaller hole 128 may be provided in the plug 127 to receive a tool that assists in removal of the plug 127 from the mat 122. The plug 127 overlies both the lift hole 116 and the interface between the lift hole 116 and the surrounding portion of the cover 112. As a result, water and debris are less likely to pass through the lift hole 116 and into the sewage line.

Figure 6:
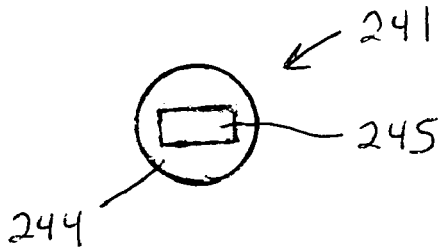
FIG. 6 is a top view of the fastener of FIG. 5.
Figure 5:
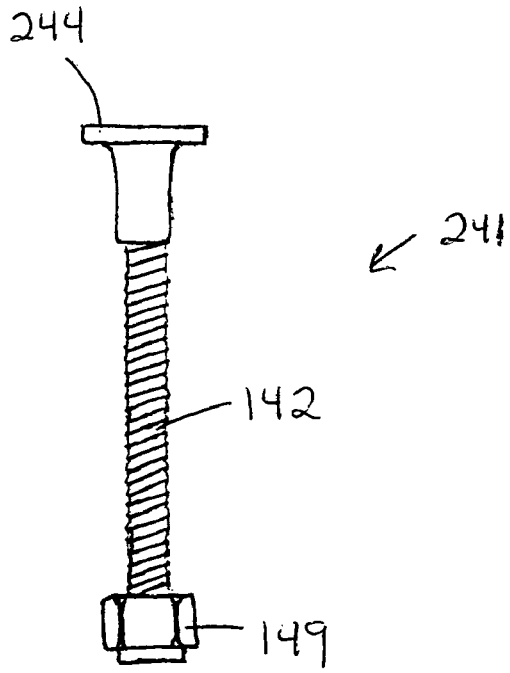
FIG. 5 is a side view of an alternative embodiment fastener suitable for use in place of the fastener of FIG. 2.

FIGS. 5–6 show an alternative embodiment fastener 241 suitable for use in place of the fastener 141. The fastener 241 includes the same threaded shaft 142 and the same nylon lock nut 149 threaded onto one end of the shaft 142. However, a different head 244 is anchored to the opposite end of the shaft 142. In particular, a non-circular opening 245 (in this example, a slot) extends axially into the top of the head 244 to provide an alternative means for resisting rotation of the fastener 244 as the nut 149 is threaded onto the shaft 142. As on the other fastener 141, the fastener 241 terminates in a relatively thin, flat flange which extends perpendicular to the shaft 142.

Although the preferred embodiment 101 is described with reference to a manhole 93, those skilled in the art will recognize that the present invention is suitable for use with other roadway openings, as well. For example, FIG. 4 also shows a valve box lid 113 in the roadway 90, and a vertical offset 98 defined between the top of the lid 113 and the top of the roadway 90. A relatively smaller mat is secured to the lid 113 to provide an assembly 103 which both covers the valve box and lies flush with the top of the road surface 90.

The foregoing description and accompanying figures are limited to specific embodiments and particular applications of the present invention. Recognizing that those skilled in the art may recognize additional improvements which incorporate aspects of the present invention, the scope of the present invention is to be limited only to the extent of the following claims.

What is claimed is:

1. A method of compensating for a vertical offset between a top surface of a paved roadway and a top surface of a cover disposed across an opening extending downward through the roadway, comprising the steps of:

providing a mat having a platform that is larger in area than the opening, and that is sized to overlie both the cover and laterally adjacent structure disposed about the opening, and the mat also having a top surface and a thickness similar to the vertical offset;

forming alignable sets of at least three circumferentially spaced holes through the mat and the cover;

providing fasteners with shafts sized and configured for insertion through the holes, and with heads which are greater in diameter than the holes;

placing the mat flat on top of the cover so that the cover is nested inside the platform of the mat;

aligning the holes in the mat with the holes in the cover; inserting the shafts through the aligned holes; and anchoring the shafts relative to a bottom side of the cover in such a manner that the heads are at least as low as the top surface of the mat.

2. The method of claim 1, wherein the mat is cut from a sheet of rubber.

3. The method of claim 1, further comprising the step of cutting a piece from the mat to define an opening in the mat which aligns with a lift hole in the cover.

4. The method of claim 3, wherein the piece is cut with sidewalls which extend in divergent fashion toward the cover, and the piece is disposed inside the opening until access to the lift hole is desired.

5. The method of claim 1, wherein the holes are provided at circumferentially spaced locations about the mat, and adjacent holes define respective arc lengths of less than ten inches therebetween.

6. The method of claim 1, wherein the fasteners are provided with threaded shafts and are anchored relative to the cover by lock nuts threaded onto the shafts.

7. The method of claim 5, wherein the fasteners are provided with heads having a flat uppermost surface and at least two pointed teeth extending downward toward the mat, and the teeth are forced into the mat during insertion of the shafts and tightening of the lock nuts.

8. The method of claim 1, wherein the fasteners are provided with heads having a flat uppermost surface and at least two pointed teeth extending downward toward the mat, and the teeth are pressed into the mat during insertion of the shafts and anchoring of the fasteners.

9. The method of claim 1, further comprising the initial step of replacing the cover with a substitute cover before performing the steps of claim 1, and then after performing the steps of claim 1, replacing the substitute cover with the cover.

10. A roadway cover assembly, comprising:

a rigid cover sized and configured to span an opening in a roadway;

a mat sized and configured to span the cover, wherein the mat rests directly on top of the cover, and at least three circumferentially spaced, circular holes extend through both the mat and the cover;

at least three fasteners, each having a shaft sized and configured for insertion through one of the holes, and a thin, flat head on one end of the shaft, wherein each of the fasteners extends through respective holes in both the mat and the cover; and a separate anchoring means for each of the fasteners, each for anchoring a respective fastener to the cover by rotating relative to a respective fastener and into a position bearing against a bottom surface on the cover to keep a respective head from protruding above the mat.

11. The roadway cover assembly of claim 10, wherein each said shaft is provided with helical threads, and each said anchoring means includes a lock nut sized and configured to be threaded onto a respective shaft.

12. The roadway cover assembly of claim 11, wherein each said head is provided with a resisting means for resisting rotation relative to the mat.

13. The roadway cover assembly of claim 12, wherein each said resisting means includes at least two pointed teeth which extend downward from a respective head and cut into the mat.

14. The roadway cover assembly of claim 12, wherein each said resisting means includes a non-circular opening extending downward into a respective head.

15. The roadway cover assembly of claim 10, wherein the mat is made of rubber, and at least part of each said head bites into the mat.

16. The roadway cover assembly of claim 10, wherein the holes are circumferentially spaced apart from one another at respective arc lengths, each of which is less than ten inches.

17. The roadway cover assembly of claim 10, wherein a piece is cut from the mat to define an opening in the mat which aligns with a lift hole in the cover.

18. The roadway cover assembly of claim 17, wherein the piece is cut with sidewalls which extend in divergent fashion toward the cover, and the piece is disposed inside the opening until access to the lift hole is desired.

19. A kit in combination with a cover which spans an opening extending downward through a paved roadway, wherein the roadway has an upper surface, and the cover is recessed below the upper surface of the roadway, comprising:

a mat sized and configured to rest on top of the cover and to span a seam defined between an outermost edge of the cover and the opening in the roadway, wherein the mat has a thickness equal to a distance measured perpendicularly between the upper surface of the cover and the upper surface of the roadway adjacent the cover, and at least three circumferentially spaced, circular holes extend through the mat in a direction parallel to the thickness of the mat;

at least three fasteners, each having a threaded shaft sized and configured to extend through both one of the holes in the mat and an aligned hole in the cover, and each having a thin, flat head on one end of the shaft, wherein each said head has a relatively large diameter than a respective one of the holes; and at least three nylon lock nuts, one associated with each of the fasteners, wherein each of the nuts is threaded onto a respective shaft and rotated into a tightened position bearing against an underside of the cover, and each of the nuts cooperates with a respective head clamp the mat and the cover therebetween.

20. The kit of claim 19, wherein the mat is made of rubber, and at least two pointed teeth extend downward from each said head, parallel to a respective shaft, and bite into the mat.

21. The kit of claim 19, wherein a piece is cut from the mat to define an opening in the mat which aligns with a lift hole in the cover.

22. A method of compensating for a vertical offset between a top surface of a paved roadway and a top surface of a cover that occupies an opening extending downward through the roadway, comprising the steps of:

providing a mat sized and configured to overlie the cover and occupy the vertical offset, wherein at least three circumferentially spaced, circular holes extend through the mat;

removing the cover from its position within the opening;

forming circumferentially spaced holes in the cover to align with the circumferentially spaced holes in the mat when the mat is aligned with the cover;

arranging the mat on top of the cover with the circumferentially spaced holes aligned;

providing fasteners sized and configured for insertion through the circumferentially spaced holes;

inserting the fasteners through respective holes in the mat and aligned holes in the cover;

providing anchors sized and configured to mate with the fasteners;

rotating the anchors onto respective fasteners at respective locations immediately beneath the cover; and returning the cover to its position within the opening, wherein at least the securing step is performed after the removing step and before the returning step.

23. The method of claim 22, wherein the anchoring step involves threading a separate nut onto each of the fasteners.

24. The method of claim 22, wherein the step of providing the mat involves providing a mat made of rubber.

25. The method of claim 24, wherein the step of providing the fasteners involves providing fasteners of a type having a shaft sized and configured to insert through the holes, and a relatively larger diameter head that is configured to bite into the mat.

26. The method of claim 25, wherein the anchoring step involves threading a separate nut onto each of the fasteners.

27. The method of claim 23, further comprising the step of cutting an opening in the mat to align with a lift hole in the cover.

28. The method of claim 27, wherein the cutting step is performed in a manner that cuts a unitary piece from the mat, and further comprising the steps of retaining the piece, and inserting the piece into the opening until access to the lift hole is desired.

29. A method of compensating for a vertical offset between a top surface of a paved roadway and a top surface of a cover that occupies an opening extending downward through the roadway, comprising the steps of:

providing a mat sized and configured to occupy the vertical offset and to overlie both the opening and structure that bounds the opening, wherein at least three circumferentially spaced holes extend through the mat;

removing the cover from its position within the opening;

forming circumferentially spaced holes in the cover to align with the circumferentially spaced holes in the mat when the mat is aligned with the cover;

arranging the mat on top of the cover with the circumferentially spaced holes aligned;

providing fasteners sized and configured for insertion through the circumferentially spaced holes;

inserting the fasteners through respective holes in the mat and aligned holes in the cover;

providing anchors sized and configured to mate with the fasteners;

rotating the anchors onto respective fasteners in a manner that clamps the mat to the cover; and returning the cover to its position within the opening so that the mat occupies the offset and overlies both the opening and the structure that borders the opening.

* * * * *